US010126080B2

(12) United States Patent
Martin

(10) Patent No.: US 10,126,080 B2
(45) Date of Patent: Nov. 13, 2018

(54) BIOMETRIC FIREARMS SAFETY SYSTEM

(71) Applicant: Roy Martin, Milwaukee, WI (US)

(72) Inventor: Roy Martin, Milwaukee, WI (US)

( * ) Notice: Subject to any disclaimer, the term of this patent is extended or adjusted under 35 U.S.C. 154(b) by 19 days.

(21) Appl. No.: 15/454,795

(22) Filed: Mar. 9, 2017

(65) Prior Publication Data

US 2018/0259280 A1 Sep. 13, 2018

(51) Int. Cl.
*F41A 17/06* (2006.01)

(52) U.S. Cl.
CPC ..... *F41A 17/066* (2013.01)

(58) Field of Classification Search
CPC ..... F41A 17/066; F41A 17/42; F41A 17/08; F41A 19/69; F41C 33/029
See application file for complete search history.

(56) References Cited

U.S. PATENT DOCUMENTS 3,581,282 A * 5/1971 Altman ..... G06K 9/00087 340/5.83
3,781,855 A * 12/1973 Killen ..... A61B 5/1172 382/126
3,939,679 A * 2/1976 Barker ..... E05B 47/068 341/181
3,978,604 A * 9/1976 Smith ..... F41A 17/063 42/70.06
4,003,152 A * 1/1977 Barker ..... E05B 47/068 42/70.01
4,015,240 A * 3/1977 Swonger ..... A61B 5/1172 382/125
4,032,889 A * 6/1977 Nassimbene ..... A61B 5/117 382/115
4,067,132 A * 1/1978 Smith ..... F41A 17/063 42/66
4,105,885 A * 8/1978 Orenstein ..... F41A 17/063 200/42.02
4,107,775 A * 8/1978 Ott ..... G07C 9/00158 382/115
4,110,928 A * 9/1978 Smith ..... F41A 17/063 42/66
4,135,320 A * 1/1979 Smith ..... F41A 17/063 42/66
4,154,014 A * 5/1979 Smith ..... F41A 17/063 42/66
4,186,378 A * 1/1980 Moulton ..... A61B 5/1172 356/71
4,467,545 A * 8/1984 Shaw, Jr. ..... G07C 9/00158 42/70.01

(Continued)

*Primary Examiner* — Troy Chambers
*Assistant Examiner* — Bridget A Cochran

(57) ABSTRACT

A biometric firearms safety system includes a firearm that has a grip and an action. A fingerprint unit is coupled to the firearm. The fingerprint unit is positioned on the grip to read fingerprints from a user. The fingerprint unit stores fingerprints from an authorized user. A locking unit is coupled to the firearm. The locking unit engages the action such that the locking unit inhibits the action from is manipulated. Thus, the locking unit inhibits the firearm from is loaded and fired. The locking unit is electrically coupled to the fingerprint unit. The locking unit disengages from the action when the user's fingerprints match the authorized user's fingerprints. Thus, the locking unit facilitates the user to load and fire the firearm.

5 Claims, 4 Drawing Sheets

(56) References Cited

U.S. PATENT DOCUMENTS 4,763,431 A * 8/1988 Allan ..... F41A 17/04 42/66
4,833,811 A * 5/1989 Wilkinson ..... F41A 17/02 42/66
4,967,502 A * 11/1990 Vernon ..... F41A 17/02 42/66
4,970,819 A * 11/1990 Mayhak ..... F41A 17/066 42/70.01
5,016,376 A * 5/1991 Pugh ..... F41A 17/063 42/70.06
5,062,232 A * 11/1991 Eppler ..... F41A 17/063 42/70.11
5,123,193 A * 6/1992 Pugh ..... F41A 17/063 42/70.06
5,192,818 A * 3/1993 Martin ..... F41A 17/06 42/70.01
5,303,495 A * 4/1994 Harthcock ..... F41A 9/62 42/1.02
5,361,525 A * 11/1994 Bowes ..... F41A 17/02 42/70.06
5,394,717 A * 3/1995 Yu ..... E05B 47/0038 292/251.5
5,423,143 A * 6/1995 Martin ..... F41A 17/06 42/106
5,448,847 A * 9/1995 Teetzel ..... F41A 17/066 42/70.05
5,459,957 A * 10/1995 Winer ..... F41A 17/066 42/70.11
5,461,812 A * 10/1995 Bennett ..... F41A 17/063 42/70.06
5,465,518 A * 11/1995 Blaser ..... F41A 17/06 42/70.08
5,502,915 A * 4/1996 Mendelsohn ..... F41A 17/066 42/70.11
5,508,683 A * 4/1996 Hall ..... F41A 17/20 340/571
5,564,211 A * 10/1996 Mossberg ..... F41A 17/08 42/70.01
5,603,179 A * 2/1997 Adams ..... F41A 17/066 42/70.06
5,619,817 A * 4/1997 Jones ..... F41A 17/06 42/66
5,675,925 A * 10/1997 Wurger ..... F41A 17/06 42/70.06
5,704,153 A * 1/1998 Kaminski ..... F41A 17/063 42/117
5,758,524 A * 6/1998 Yu ..... E05B 47/0038 292/251.5
5,812,252 A * 9/1998 Bowker ..... F41A 17/066 250/227.11
5,915,936 A * 6/1999 Brentzel ..... F41A 17/063 42/70.11
5,937,557 A * 8/1999 Bowker ..... F41A 17/066 102/472
5,946,840 A * 9/1999 Mickel ..... F41A 17/06 42/70.11
6,141,896 A * 11/2000 Oberst ..... F41A 17/02 42/70.06
6,144,756 A * 11/2000 Takahashi ..... G06K 9/0002 340/5.86
6,185,852 B1 * 2/2001 Whalen ..... F41A 17/066 42/70.11
6,219,952 B1 * 4/2001 Mossberg ..... F41A 17/063 42/70.01
6,237,271 B1 * 5/2001 Kaminski ..... F41A 17/063 42/70.01
6,253,480 B1 * 7/2001 Florez ..... F41A 17/06 42/70.06
6,260,300 B1 * 7/2001 Klebes ..... F41A 17/066 206/317
6,286,241 B1 * 9/2001 Constant ..... F41A 19/58 42/84
6,286,242 B1 * 9/2001 Klebes ..... F41A 17/066 42/70.01
6,293,039 B1 * 9/2001 Fuchs ..... F41A 17/04 42/70.04
6,301,815 B1 * 10/2001 Sliwa ..... F41A 17/066 42/70.01
6,330,346 B1 * 12/2001 Peterson ..... E05B 1/0015 382/115
6,343,140 B1 * 1/2002 Brooks ..... F41A 17/066 348/156
6,345,461 B1 * 2/2002 Constant ..... F41A 17/04 42/70.11
6,345,462 B1 * 2/2002 Mikuta ..... F41A 19/58 42/65
6,354,033 B1 * 3/2002 Findley ..... F41A 19/58 42/70.01
6,357,156 B1 * 3/2002 Klebes ..... F41A 17/066 42/70.01
6,357,157 B1 * 3/2002 Constant ..... F41A 19/58 42/65
6,360,468 B1 * 3/2002 Constant ..... F41A 9/53 42/65
6,360,469 B1 * 3/2002 Mikuta ..... F41A 17/066 42/70.11
6,360,470 B1 * 3/2002 Constant ..... F41A 19/70 42/84
6,397,508 B1 * 6/2002 Constant ..... F41A 9/65 42/69.01
6,405,471 B1 * 6/2002 Mauch ..... F41A 19/14 42/66
6,405,473 B1 * 6/2002 Petig ..... F41A 19/70 42/69.02
6,408,555 B1 * 6/2002 Sapia ..... F41A 17/06 42/70.07
6,412,207 B1 * 7/2002 Crye ..... F41A 17/02 42/70.01
6,412,208 B1 * 7/2002 Mikuta ..... F41G 1/345 42/132
6,415,542 B1 * 7/2002 Bates ..... F41A 17/06 42/70.05
6,421,944 B1 * 7/2002 Klebes ..... F41A 17/06 42/70.11
6,425,199 B1 * 7/2002 Vaid ..... F41A 9/65 42/69.01
6,430,860 B1 * 8/2002 Constant ..... F41A 9/65 42/84
6,434,875 B1 * 8/2002 Constant ..... F41A 15/16 42/70.11
6,442,880 B1 * 9/2002 Allan ..... F41A 17/066 42/66
6,499,243 B1 * 12/2002 Herzog ..... F41A 17/066 42/70.06
6,563,940 B2 * 5/2003 Recce ..... B60R 25/04 382/120
6,631,579 B1 * 10/2003 Lauster ..... F41A 17/066 42/70.01
6,641,009 B2 * 11/2003 French ..... F41C 33/0209 224/193
6,711,843 B2 * 3/2004 Klebes ..... F41A 17/066 42/70.11
6,718,679 B2 * 4/2004 Herzog ..... F41A 17/066 42/70.07
6,817,130 B2 * 11/2004 Ivanov ..... F41A 17/20 382/121
6,826,000 B2 * 11/2004 Lee ..... A61B 5/103 356/71
6,870,946 B1 * 3/2005 Teng ..... G06K 9/00046 356/458
6,874,265 B1 * 4/2005 Pathak ..... F41A 17/066 42/70.06
6,917,695 B2 * 7/2005 Teng ..... G06K 9/00046 382/126
6,993,165 B2 * 1/2006 McClurg ..... G06K 9/00013 353/81
7,081,951 B2 * 7/2006 Carver ..... G06K 9/00046 356/71

(56) References Cited

U.S. PATENT DOCUMENTS 7,155,855 B2 * 1/2007 Mauch ..... F41A 17/063 42/70.01
D593,629 S * 6/2009 Bantle ..... D22/104
7,849,624 B2 * 12/2010 Holt ..... F41A 17/066 340/5.81
8,046,948 B2 * 11/2011 Mauch ..... F41A 17/063 42/70.01
8,141,758 B2 * 3/2012 Spielberger ..... F41C 33/0263 224/238
8,207,816 B2 * 6/2012 Crigger ..... G07C 9/00158 340/5.52
8,418,391 B2 * 4/2013 Kemmerer ..... F41A 17/066 42/70.05
8,464,451 B2 * 6/2013 McRae ..... F41A 17/06 42/1.01
8,503,972 B2 * 8/2013 Haler ..... G01S 5/0009 455/103
8,893,420 B2 * 11/2014 Milde, Jr. ..... F41A 35/00 42/70.04
8,919,024 B2 * 12/2014 Milde, Jr. ..... F41A 17/066 42/70.01
8,966,797 B2 * 3/2015 Carlson ..... F41A 17/063 42/1.01
9,032,657 B1 * 5/2015 Walker ..... F41A 17/46 42/70.11
9,097,479 B1 * 8/2015 Barido ..... F41A 17/066
9,341,424 B2 * 5/2016 Allan ..... F41A 17/06
9,377,259 B2 * 6/2016 Milde, Jr. ..... F41A 17/063
9,400,150 B2 * 7/2016 Stewart ..... H04W 4/70
9,404,698 B2 * 8/2016 Stewart ..... F41A 17/063
9,404,699 B1 * 8/2016 Barido ..... F41A 17/066
9,591,255 B2 * 3/2017 Sakiewicz ..... H04N 5/772
9,726,448 B1 * 8/2017 Milde, Jr. ..... F41A 17/063
9,733,033 B1 * 8/2017 Barido ..... F41A 17/066
9,739,555 B2 * 8/2017 Milde, Jr. ..... F41A 17/063
9,797,670 B2 * 10/2017 Winiecki ..... F41A 17/066
9,857,133 B1 * 1/2018 Kloepfer ..... F41A 17/066
2001/0019071 A1 * 9/2001 Vor Keller ..... F41A 17/066 224/244
2001/0048009 A1 * 12/2001 Vor Keller ..... F41A 17/066 224/244
2002/0158095 A1 * 10/2002 Vor Keller ..... E05B 47/0603 224/244
2002/0170220 A1 * 11/2002 Recce ..... B60R 25/04 42/70.08
2002/0181747 A1 * 12/2002 Topping ..... F41A 17/066 382/124
2003/0070343 A1 * 4/2003 Glock ..... F41A 17/063 42/70.11
2003/0136043 A1 * 7/2003 Lauster ..... F41A 17/066 42/70.11
2004/0031180 A1 * 2/2004 Ivanov ..... F41A 17/066 42/70.11
2004/0099134 A1 * 5/2004 Gotfried ..... F41A 17/066 89/1.11
2005/0188583 A1 * 9/2005 Jackson ..... F41A 17/06 42/70.11
2008/0060246 A1 * 3/2008 Rozovsky ..... F41A 17/06 42/70.01
2011/0056108 A1 * 3/2011 McCord ..... F41A 17/066 42/70.01
2011/0061280 A1 * 3/2011 Emde ..... F41A 17/063 42/70.06
2013/0019510 A1 * 1/2013 Kemmerer ..... F41A 17/066 42/1.01
2013/0019512 A1 * 1/2013 Kemmerer ..... F41A 17/066 42/70.05
2013/0125441 A1 * 5/2013 Westwood ..... F41A 17/02 42/70.05
2016/0054083 A1 * 2/2016 Kiyani ..... F41A 17/063 42/70.11
2017/0074611 A1 * 3/2017 Winiecki ..... F41A 17/066
2017/0077741 A1 * 3/2017 Winiecki ..... H02J 7/025

* cited by examiner

BIOMETRIC FIREARMS SAFETY SYSTEM

BACKGROUND OF THE DISCLOSURE

Field of the Disclosure

The disclosure relates to safety devices and more particularly pertains to a new safety device for inhibiting an unauthorized user from loading and firing a firearm.

SUMMARY OF THE DISCLOSURE

An embodiment of the disclosure meets the needs presented above by generally comprising a firearm that has a grip and an action. A fingerprint unit is coupled to the firearm. The fingerprint unit is positioned on the grip to read fingerprints from a user. The fingerprint unit stores fingerprints from an authorized user. A locking unit is coupled to the firearm. The locking unit engages the action such that the locking unit inhibits the action from is manipulated. Thus, the locking unit inhibits the firearm from is loaded and fired. The locking unit is electrically coupled to the fingerprint unit. The locking unit disengages from the action when the user's fingerprints match the authorized user's fingerprints. Thus, the locking unit facilitates the user to load and fire the firearm.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
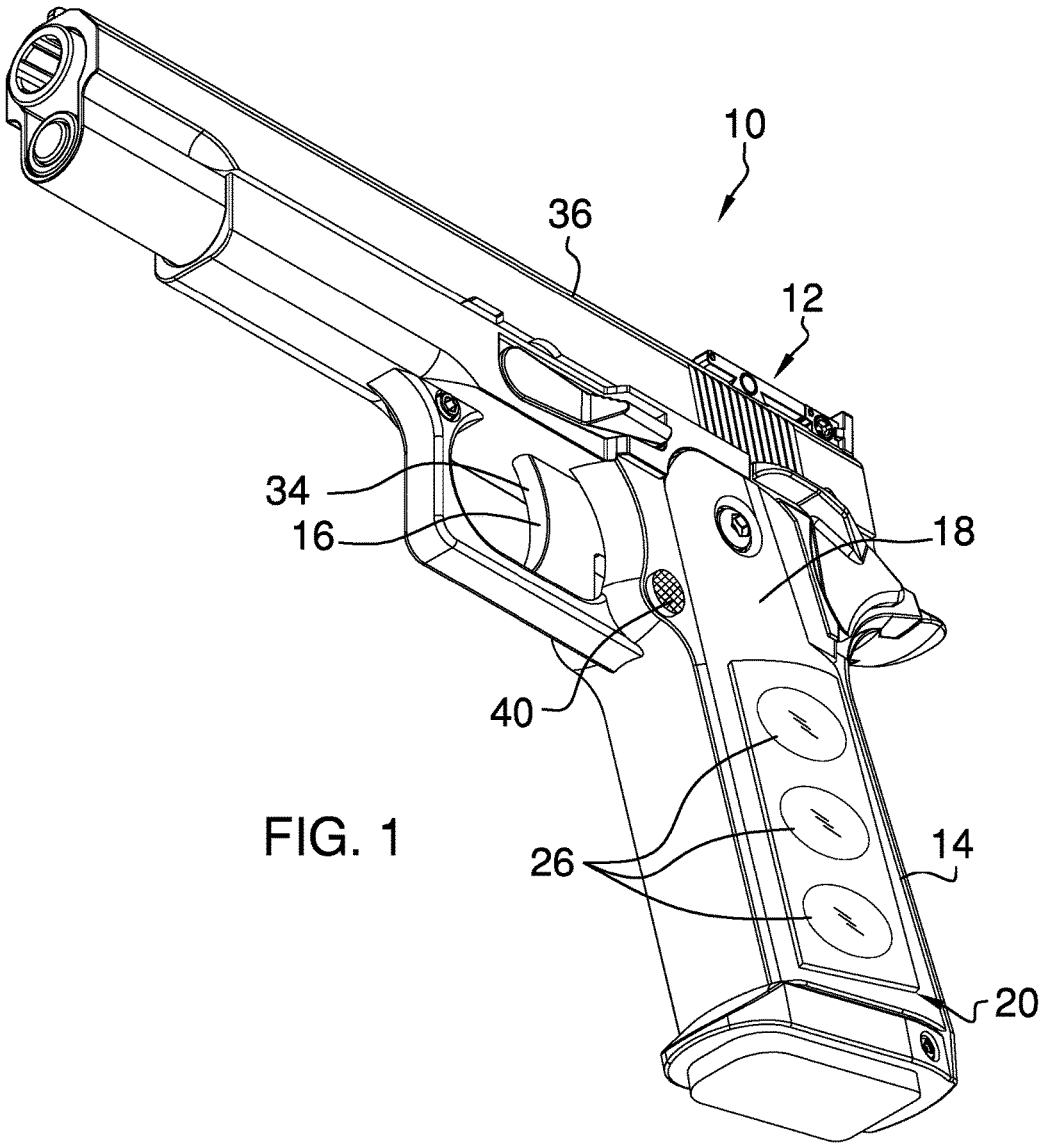
FIG. 1 is a perspective view of a biometric firearms safety system according to an embodiment of the disclosure.
Figure 3:
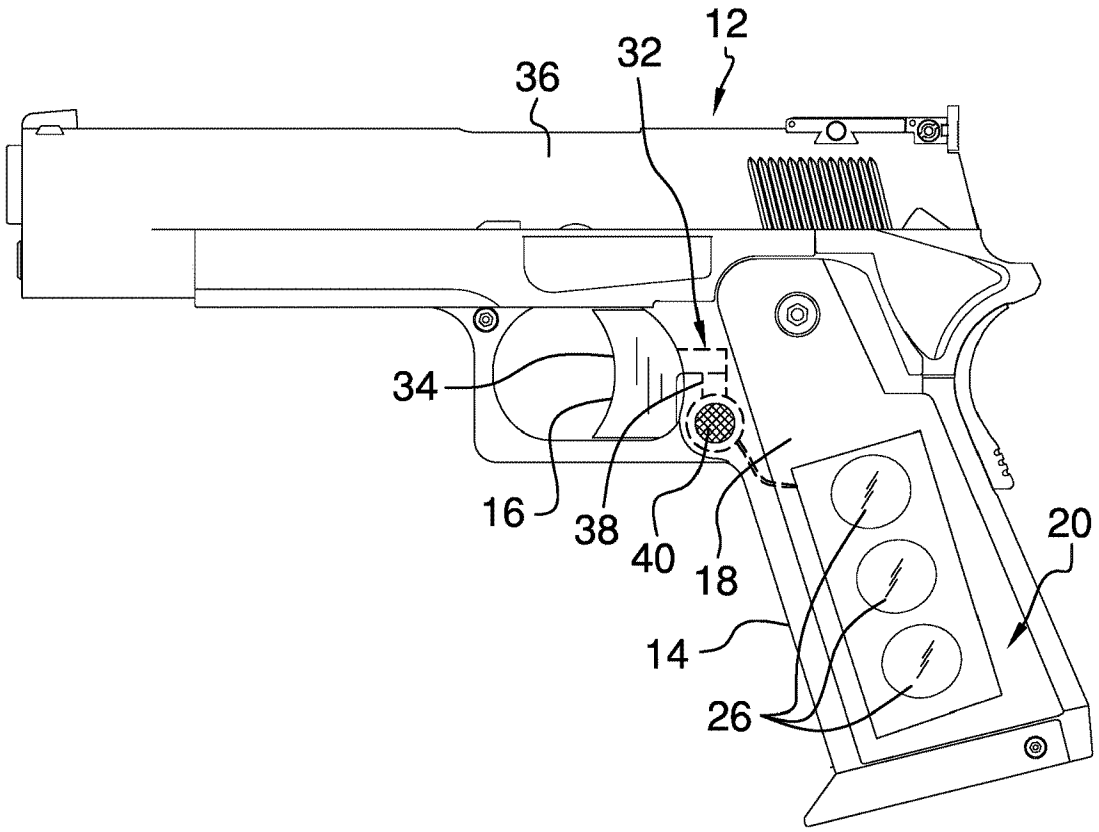
FIG. 3 is a left side view of an embodiment of the disclosure.
Figure 2:
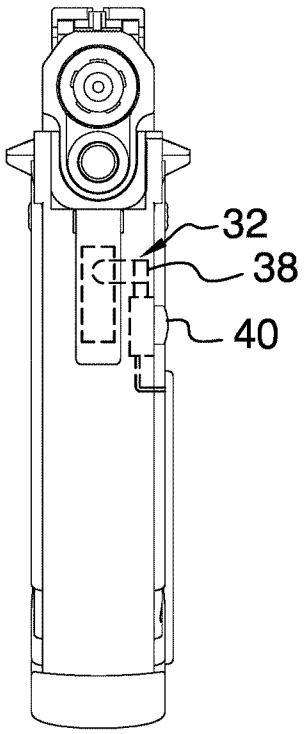
FIG. 2 is a front view of an embodiment of the disclosure.
Figure 4:
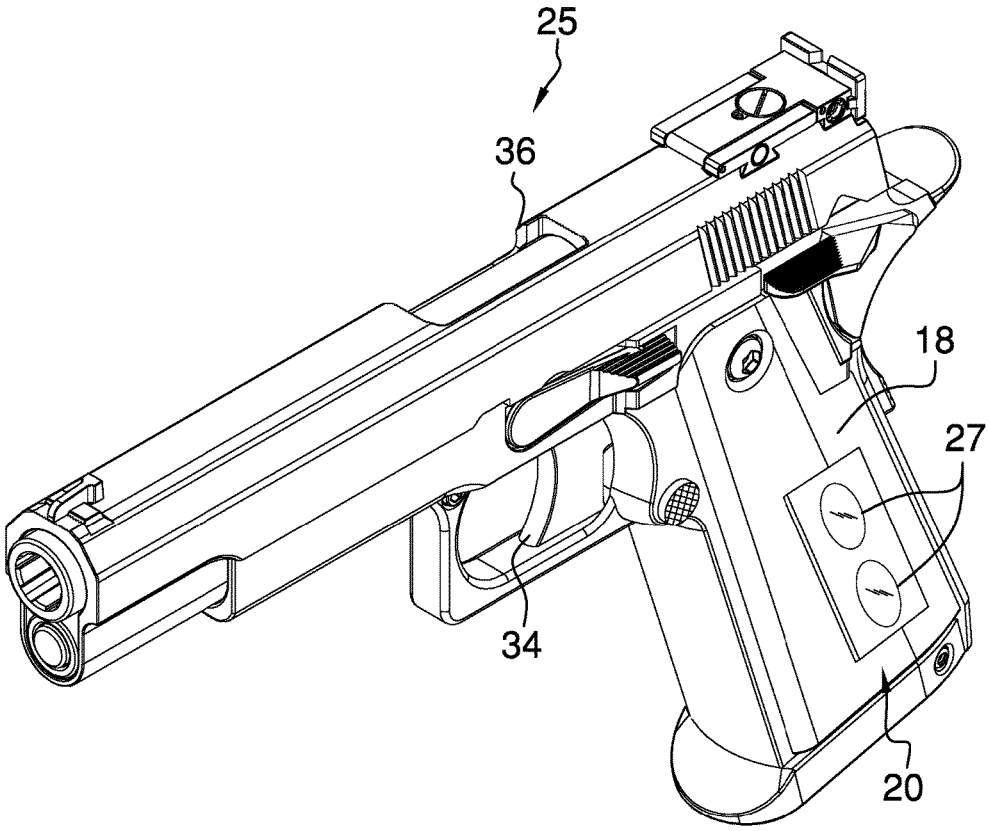
FIG. 4 is a perspective view of an alternative embodiment of the disclosure.
Figure 5:
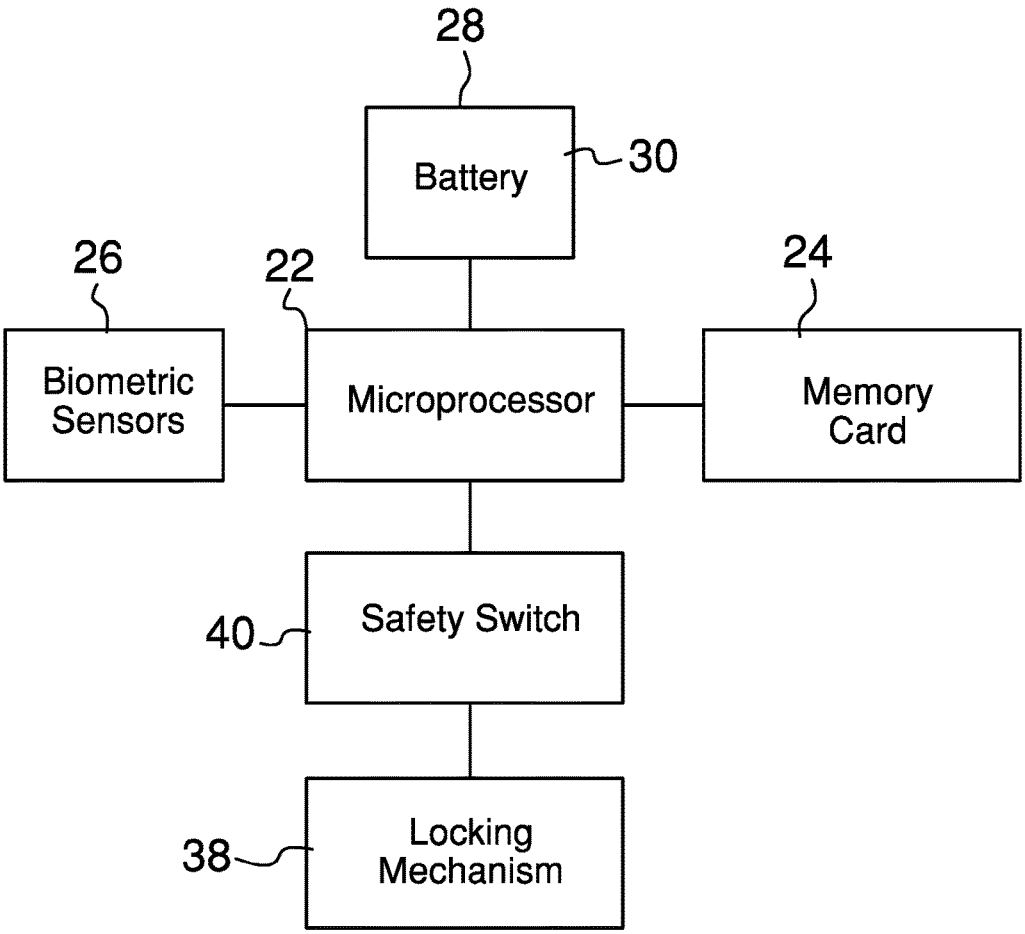
FIG. 5 is a schematic view of an embodiment of the disclosure.

With reference now to the drawings, and in particular to FIGS. 1 through 5 thereof, a new safety device embodying the principles and concepts of an embodiment of the disclosure and generally designated by the reference numeral 10 will be described.

As best illustrated in FIGS. 1 through 5, the biometric firearms safety system 10 generally comprises a firearm 12 that has a grip 14 and an action 16. The firearm 12 may comprise a handgun or the like. The grip 14 may have a first lateral side 18. A fingerprint unit 20 is coupled to the firearm 12. The fingerprint unit 20 is positioned on the grip 14 to read fingerprints from a user.

The fingerprint unit 20 comprises a processor 22 that is coupled to the firearm 12. An electronic memory 24 is coupled to the firearm 12. The electronic memory 24 is electrically coupled to the processor 22. The electronic memory 24 stores fingerprints of an authorized user. The processor 22 may comprise an electronic processor or the like. The electronic memory 24 may comprise RAM memory or the like.

A plurality of sensors 26 is provided and each of the sensors 26 is coupled to the grip 14. The sensors 26 are spaced apart from each other and distributed along the grip 14. Additionally, each of the sensors 26 may be positioned on the first lateral side 18 of the grip 14. Thus, each of the sensors 26 may read a fingerprint from an associated one of a user's fingers when the user grips the grip 14. Each of the sensors 26 may comprise an electronic fingerprint reader or the like. In an alternative embodiment 25 as shown in figured 4, a pair of sensors 27 may be provided.

Each of the sensors 26 is electrically coupled to the processor 22. The processor 22 generates an unlock sequence when the sensors 26 read fingerprints that matches the authorized user's fingerprints stored in the electronic memory 24. The processor 22 generates a record sequence when the sensors 26 read fingerprints that do not match the authorized user's fingerprints. Thus, the electronic memory 24 stores the fingerprints that do not match the authorized user's fingerprints.

A power supply 28 is provided. The power supply 28 is coupled to the firearm 12. The power supply 28 is electrically coupled to the processor 22. The power supply 28 comprises at least one battery 30.

A locking unit 32 is coupled to the firearm 12. The locking unit 32 engages the action 16 such that the locking unit 32 inhibits the action 16 from being manipulated. Thus, the locking unit 32 inhibits the firearm 12 from being fired. The locking unit 32 is electrically coupled to the fingerprint unit 20. The locking unit 32 disengages from the action 16 when user's fingerprints match the authorized user's fingerprints. Thus, the locking unit 32 facilitates the user to fire the firearm 12. The action 14 may include a trigger 34 and a slide 36.

The locking unit 32 comprises a lock 38 that is coupled to the firearm 12. The lock 38 is biased into a locking position. Thus, the lock 38 mechanically engages the action 14 to inhibit the action 14 from being manipulated. The lock 38 may inhibit the trigger 34 from being pulled. Thus, the firearm 12 is inhibited from being fired. Additionally, the lock 38 may inhibit the slide 36 from being manipulated. Thus, the firearm 12 is inhibited from being loaded.

The lock 38 is electrically coupled to the processor 22. The lock 38 is actuated into an unlocked position when the processor 22 generates the unlock sequence. Thus, the lock 38 mechanically disengages the action 14 to facilitate the action 14 to be manipulated. The lock 38 may comprise an electrically actuated solenoid or the like.

A button 40 is coupled to the lock 38 and the button 40 may be manipulated. The button 40 urges the lock 38 into the locking position when the processor 22 generates the unlock sequence. Thus, the lock 38 inhibits the action 14 from being manipulated. The button 40 may comprise a gun safety or the like.

In use, the authorized user's fingerprints are uploaded into the electronic memory 24. Each of the sensors 26 reads the user's fingerprints when the user grips the grip 14. The processor 22 generates the unlock sequence when the user's fingerprints match the authorized user's fingerprints. Thus, the firearm 12 may be loaded and fired.

The processor 22 does not generate the unlock sequence when the user's fingerprints do not match the authorized user's fingerprints. Thus, the firearm 12 may not be loaded and fired. The processor 22 generates the record sequence when the user's fingerprints do not match the authorized user's fingerprints. The user's fingerprints are stored in the electronic memory 24. Thus, the user's fingerprints may be collected for as evidence for legal purposes.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A biometric firearms safety system comprising:

a firearm having a grip and an action;

a fingerprint unit being coupled to said firearm, said fingerprint unit being positioned on said grip wherein said fingerprint unit is configured to read fingerprints from a user, said fingerprint unit storing fingerprints from a previously authorized user, wherein said fingerprint unit comprises a processor being coupled to said firearm, and an electronic memory being coupled to said firearm, said electronic memory being electrically coupled to said processor, said electronic memory storing fingerprints of the previously authorized user;

a locking unit being coupled to said firearm, said locking unit engaging said action such that said locking unit inhibits said action from being manipulated wherein said locking unit is configured to inhibit said firearm from being loaded and fired, said locking unit being electrically coupled to said fingerprint unit, said locking unit disengaging from said action when fingerprints of a current user match the fingerprints of the previously authorized user wherein said locking unit is configured to facilitate the current user to load and fire said firearm; and said fingerprint unit further including a plurality of sensors, each of said sensors being coupled to said grip wherein each of said sensors is configured to read the fingerprint from a respective finger of the current user when the current user grips said grip, each of said sensors being electrically coupled to said processor, said processor generating an unlock sequence when said sensors read fingerprints of the current user match the fingerprints of the previously authorized user stored in said electronic memory, said processor generating a record sequence when said sensors read fingerprints that do not match the authorized user's fingerprints wherein said electronic memory is configured to store the fingerprints of the current user that do not match the fingerprints of the previously authorized user.

2. The assembly according to claim 1, further comprising a power supply being coupled to said firearm, said power supply being electrically coupled to said processor, said power supply comprising at least one battery.

3. The assembly according to claim 1, wherein: said locking unit comprises a lock being coupled to said firearm, said lock being biased into a locking position having said lock mechanically engaging said action wherein said lock is configured to inhibit said action from being manipulated, said lock being electrically coupled to said processor, said lock being actuated into an unlocked position when said processor generates said unlock sequence having said lock mechanically disengaging said action wherein said lock is configured to facilitate said action to be manipulated.

4. The assembly according to claim 3, further comprising a button being coupled to said lock wherein said button is configured to be manipulated, said button urging said lock into said locking position when said processor generates said unlock sequence wherein said lock is configured to inhibit said action from being manipulated.

5. A biometric firearms safety system comprising:

a firearm having a grip and an action;

a fingerprint unit being coupled to said firearm, said fingerprint unit being positioned on said grip wherein said fingerprint unit is configured to read fingerprints from a current user, said fingerprint unit comprising:

a processor being coupled to said firearm, an electronic memory being coupled to said firearm, said electronic memory being electrically coupled to said processor, said electronic memory storing fingerprints of a previously authorized user, a plurality of sensors, each of said sensors being coupled to said grip wherein each of said sensors is configured to read the fingerprint from a respective finger of the current user when the current user grips said grip, each of said sensors being electrically coupled to said processor, said processor generating an unlock sequence when said sensors read fingerprints of the current user match the fingerprints of the previously authorized user stored in said electronic memory, said processor generating a record sequence when said sensors read fingerprints that do not match the authorized user's fingerprints wherein said electronic memory is configured to store the fingerprints of the current user that do not match the fingerprints of the previously authorized user, and a power supply being coupled to said firearm, said power supply being electrically coupled to said processor, said power supply comprising at least one battery; and a locking unit being coupled to said firearm, said locking unit engaging said action such that said locking unit inhibits said action from being manipulated wherein said locking unit is configured to inhibit said firearm from being fired, said locking unit being electrically coupled to said fingerprint unit, said locking unit disengaging from said action to allow firing said firearm, said locking unit comprising:

a lock being coupled to said firearm, said lock being biased into a locking position having said lock mechanically engaging said action wherein said lock is configured to inhibit said action from being manipulated, said lock being electrically coupled to said processor, said lock being actuated into an unlocked position when said processor generates said unlock sequence having said lock mechanically disengaging said action wherein said lock is configured to facilitate said action to be manipulated, and a button being coupled to said lock wherein said button is configured to be manipulated, said button urging said lock into said locking position when said processor generates said unlock sequence wherein said lock is configured to inhibit said action from being manipulated.

* * * * *